US011771932B2

(12) United States Patent
Shelton et al.

(10) Patent No.: US 11,771,932 B2
(45) Date of Patent: Oct. 3, 2023

(54) STORAGE RECEPTACLES WITH FIRE SUPPRESSION

(71) Applicant: Hewlett-Packard Development Company, L.P., Spring, TX (US)

(72) Inventors: Gerold Keith Shelton, Boise, ID (US); Kyle J Nottingham, Boise, ID (US); Matthew Frederickson, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/481,817

(22) PCT Filed: Apr. 30, 2018

(86) PCT No.: PCT/US2018/030161

§ 371 (c)(1),
(2) Date: Jul. 29, 2019

(87) PCT Pub. No.: WO2019/212476

PCT Pub. Date: Nov. 7, 2019

(65) Prior Publication Data

US 2021/0402231 A1 Dec. 30, 2021

(51) Int. Cl.

| | |
|---|---|
| ***A62C 3/00*** | (2006.01) |
| ***A62C 2/06*** | (2006.01) |
| ***A62C 35/13*** | (2006.01) |
| ***A62C 37/38*** | (2006.01) |
| ***A62C 3/16*** | (2006.01) |

(52) U.S. Cl.

CPC ..... *A62C 3/002* (2013.01); *A62C 2/06* (2013.01); *A62C 3/16* (2013.01); *A62C 35/13* (2013.01); *A62C 37/38* (2013.01)

(58) Field of Classification Search

CPC .. A62C 2/06; A62C 3/002; A62C 3/16; A62C 35/13; A62C 37/38

USPC ..... 169/48–50

See application file for complete search history.

(56) References Cited

U.S. PATENT DOCUMENTS

| | | | | |
|---|---|---|---|---|
| 4,958,554 A * | 9/1990 | Spaeth | F24F 13/02 169/48 |
| 5,016,715 A * | 5/1991 | Alasio | A62C 35/11 169/26 |
| 6,618,644 B2 | 9/2003 | Bean | |

(Continued)

FOREIGN PATENT DOCUMENTS

| | | |
|---|---|---|
| CN | 2520366 Y | 11/2002 |
| CN | 200977353 | 11/2007 |

(Continued)

*Primary Examiner* — Cody J Lieuwen

(74) *Attorney, Agent, or Firm* — Quarles & Brady LLP

(57) ABSTRACT

An example apparatus includes a cabinet body and a first storage receptacle at the cabinet body. The first storage receptacle is to temporarily store an electronic device. The apparatus further includes a second storage receptacle at the cabinet body. The second storage receptacle is to temporarily store another electronic device. The second storage receptacle is separate from the first storage receptacle to prevent physical access to the first storage receptacle through the second storage receptacle. The apparatus further includes a fire suppression mechanism to independently suppress a fire in the first storage receptacle or a fire in the second storage receptacle.

19 Claims, 6 Drawing Sheets

(56) References Cited

U.S. PATENT DOCUMENTS

| | | | | |
|---|---|---|---|---|
| 6,736,473 | B2 | 5/2004 | Cleveland et al. | |
| 9,276,418 | B2 | 3/2016 | Kawasaki et al. | |
| 9,452,884 | B2 | 9/2016 | Rutledge et al. | |
| 2002/0194793 | A1 | 12/2002 | Bowron | |
| 2004/0132398 | A1* | 7/2004 | Sharp | A62C 3/16 454/184 |
| 2005/0225936 | A1* | 10/2005 | Day | H05K 7/20745 361/679.47 |
| 2009/0216381 | A1* | 8/2009 | Gooch | A62C 3/16 700/277 |
| 2011/0234058 | A1* | 9/2011 | Lee | G21F 7/00 312/31.1 |
| 2012/0219785 | A1 | 8/2012 | Yu et al. | |
| 2017/0077467 | A1* | 3/2017 | Kronke | H01M 10/63 |
| 2017/0237054 | A1* | 8/2017 | Mast | H01M 10/42 320/107 |
| 2017/0361139 | A1* | 12/2017 | Koreis | B64D 37/32 |
| 2019/0044326 | A1* | 2/2019 | Williams | A62C 3/16 |

FOREIGN PATENT DOCUMENTS

| | | | |
|---|---|---|---|
| CN | 102102450 | A | 6/2011 |
| CN | 201912668 | | 8/2011 |
| CN | 104511106 | | 4/2015 |
| CN | 105390944 | | 3/2016 |
| CN | 105901972 | | 8/2016 |
| CN | 205457178 | | 8/2016 |
| CN | 106139455 | A | 11/2016 |
| CN | 107204573 | | 9/2017 |
| CN | 206517702 | | 9/2017 |
| CN | 107359373 | A | 11/2017 |
| CN | 107359373 | A | 11/2017 |
| CN | 107681741 | | 2/2018 |
| CN | 206964922 | | 2/2018 |
| CN | 206976521 | | 2/2018 |
| CN | 107788712 | | 3/2018 |
| CN | 207137196 | | 3/2018 |
| CN | 207152911 | | 3/2018 |
| CN | 207152929 | | 3/2018 |
| EP | 2592705 | A1 | 5/2013 |
| EP | 2592705 | A1 | 6/2015 |
| JP | 54170229 | | 12/1979 |

* cited by examiner

STORAGE RECEPTACLES WITH FIRE SUPPRESSION

BACKGROUND

Electronic devices, such as notebook computers, tablet computers, and smartphones are increasingly used in various ways. It is becoming increasingly prevalent to view such devices as a means to an end by providing functionality rather than merely hardware. Traditional ownership of such devices is giving way to more flexible use cases.

DETAILED DESCRIPTION

A device-as-a-service (DaaS) ecosystem provides electronic devices to users. A particular device may be used by a particular user for a given amount of time. The device may be returned by the user, who may then be assigned a new device. A device may be stored when the user is not using the device. A storage apparatus may be used to physically secure devices that are not in possession of users. A storage apparatus may provide network connectivity to the device, so as to maintain its software, as well as power connectivity, which may be useful in charging a battery of the device. An organization, such as a company, may have multiple storage apparatuses on its premises, so that users (e.g., employees, customers, visitors, etc.) may take and return devices according to the goals of the organization.

A storage apparatus may include a plurality of storage receptacles to store a plurality of electronic devices in a way that addresses a risk of fire. Such a fire may result from a damaged or defective battery contained by a device or from a short circuit in the device or in the wiring of a storage receptacle. For example, devices containing lithium ion batteries may cause unexpected and serious fires.

The storage apparatus may prevent a fire from spreading from one storage receptacle to another or to outside the storage apparatus. The storage receptacle in which a fire originated may be taken out of service and other storage receptacles may continue to be used. A fire suppression mechanism may be provided to suppress a fire in a storage receptacle. The storage receptacle may be locked and access to other receptacles may still be granted in the meantime. The cabinet may include fire-resistant material to inhibit the spread of fire among storage receptacles. A sensor may be provided to a storage receptacle to trigger the fire suppression mechanism or issue a notification about the fire to a remote administrator of the storage apparatus.

Figure 1:
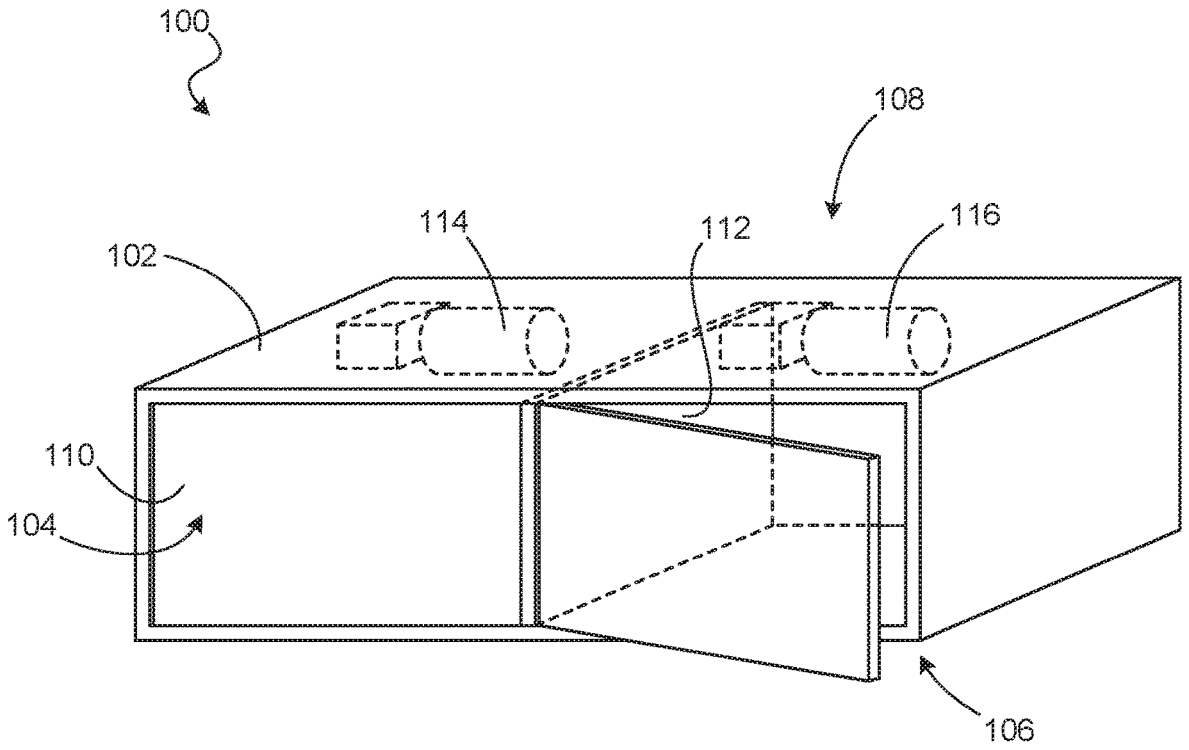
FIG. 1 is a perspective view of an example apparatus to provide fire suppression to device storage receptacles.

FIG. 1 shows an example apparatus 100 to provide fire suppression to device storage receptacles. The apparatus 100 may be termed a cabinet, locker, kiosk, or storage unit. A device storage receptacle may be termed a cubby. The apparatus 100 may temporarily store electronic devices, such as notebook computers, tablet computers, smartphones, and the like. The apparatus 100 may allow a user to obtain an electronic device for a duration of use before returning the electronic device to the apparatus 100 or to a similar apparatus. The apparatus 100 may provide physical security to the stored electronic devices, as well as power and data communications. The apparatus 100 may be used in a DaaS environment to allow the storage and sign out of electronic devices to various users.

The apparatus 100 includes a cabinet body 102, a first storage receptacle 104, a second storage receptacle 106, and a fire suppression mechanism 108. The number of storage receptacles provided is not particularly limited, and various example implementations may have from five to 40 storage receptacles, for instance. More or fewer are possible.

The cabinet body 102 may include a housing made of metal or other fire-resistant material. For example, the cabinet body 102 may include metal walls with added fire-resistant material (e.g., fiberglass, mineral wool, etc.). In some examples, an external wall of the cabinet body 102 may include two metal panels that sandwich compressed mineral wool. The cabinet body 102 may further include support structure, such as legs to support the apparatus on the floor, fastener points to secure the apparatus 100 to a wall, or similar.

The first storage receptacle 104 is defined at the cabinet body 102 to temporarily store an electronic device. For example, the first storage receptacle 104 may include an internal volume within the cabinet body 102 and an access door 110 that may be opened to access the internal volume. The internal volume may be shaped and sized to receive an electronic device. The access door 110 may be lockable and may be automatically lockable in response to detection of a sign of fire.

The second storage receptacle 106 may be similar or identical to the first storage receptacle 104. The second storage receptacle 106 and the first storage receptacle 104 are separated to prevent physical access to the first storage receptacle 104 through the second storage receptacle 106, and vice versa. That is, an electronic device stored in one of the storage receptacles 104, 106 cannot be removed via the other storage receptacle 104, 106.

In this example, a barrier 112, such as a divider wall, is positioned between the first storage receptacle 104 and the second storage receptacle 106. The barrier 112 may include fire-resistant material. For example, the barrier 112 may include a metal wall with added fire-resistant material (e.g., fiberglass, mineral wool, etc.). In some examples, the barrier 112 may include two metal panels that sandwich compressed mineral wool. The barrier 112 may prevent the spread of fire, heat, or smoke.

The fire suppression mechanism 108 independently suppresses a fire in the first storage receptacle 104 or a fire in the second storage receptacle 106. That is, fire suppression may be delivered to the particular storage receptacle 104, 106 undergoing a fire and may be withheld from the other storage receptacle 104, 106. Such a fire may be caused by a malfunctioning battery of an electronic device stored within a storage receptacle 104, 106, a short circuit in wiring running to a storage receptacle 104, 106, or similar. The fire suppression mechanism 108 is provided to suppress a fire in an affected storage receptacle 104, 106 and reduce or prevent the spread of fire to another storage receptacle 104, 106 or to outside the cabinet body 102.

The fire suppression mechanism 108 may include a first fire suppression device 114 at the first storage receptacle 104 and a second fire suppression device 116 at the second storage receptacle 106. The first fire suppression device 114 may include a sensor-activated charge of fire suppression/extinguishing material, such as carbon dioxide, sodium carbonate, dry chemical powder (type ABC, type B, etc.), foam, halon gas, or other material suitable for the type of fire expected.

The second fire suppression device 116 may be similar or identical to the first fire suppression device 114. The second fire suppression device 116 and the first fire suppression device 114 may be independently operable, such that triggering of one fire suppression device 114, 116 does not necessarily result in the triggering of the other fire suppression device 114, 116. As such, potential damage to an electronic device stored in a storage receptacle 104, 106 unaffected by fire may be avoided when a fire suppression device 114, 116 in another storage receptacle 104, 106 is activated. Further, independent operation may reduce an amount of suppression/extinguishing material that needs to be recharged after a fire. Moreover, it may be the case that a storage receptacle 104, 106 unaffected by fire may continue to be used after extinguishment of a fire in an affected storage receptacle 104, 106 and before the affected storage receptacle 104, 106 is returned to service.

Figure 2:
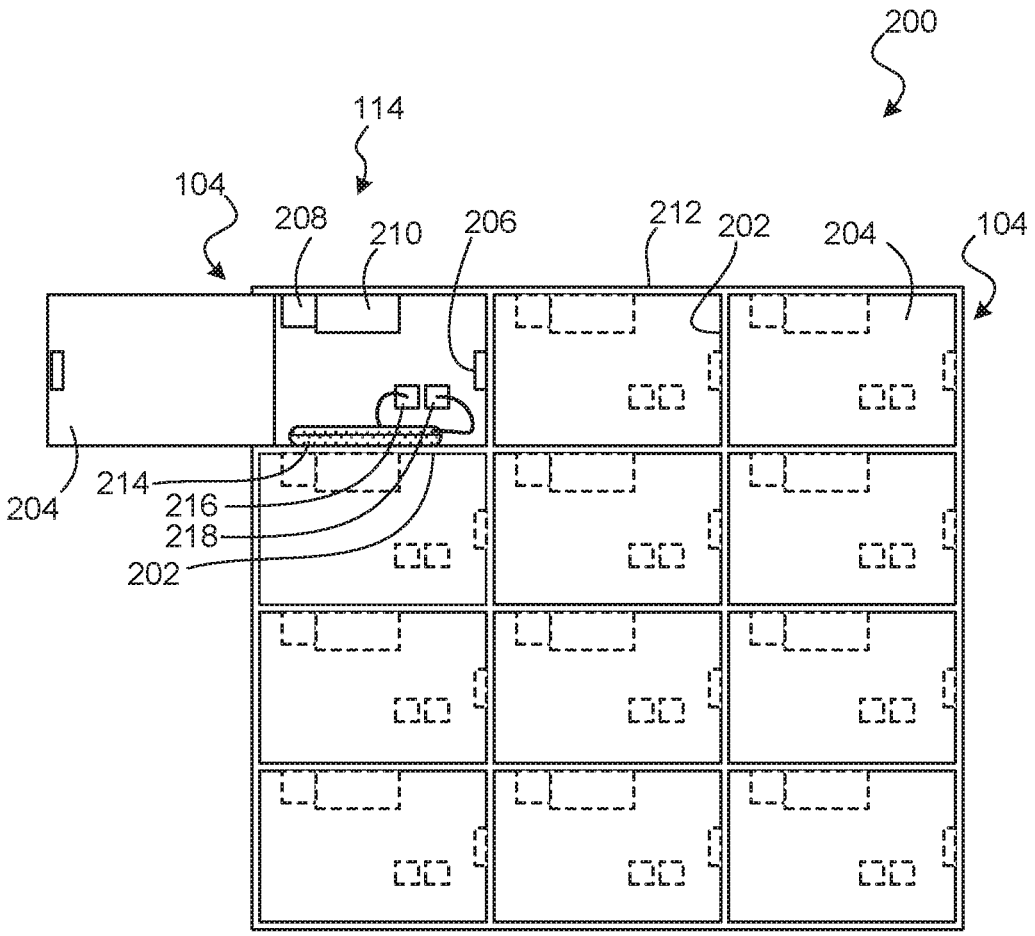
FIG. 2 is a front view of an example apparatus to provide fire suppression to lockable device storage receptacles.

FIG. 2 shows another example apparatus 200 to provide fire suppression to device storage receptacles. Features and aspects of other apparatuses disclosed herein may be used with the apparatus 200. Like reference numerals denote like components and redundant description is omitted for clarity.

The apparatus 200 includes an array of storage receptacles 104 separated by fire-resistant barriers 202. The array of storage receptacles 104 may be contained by or may form a cabinet body 212. The array may be rectangular, as depicted, or have another geometry.

A storage receptacle 104 may include a lockable access door 204 that may be locked closed by a locking mechanism 206. In the figure, one storage receptacle 104 is depicted with its lockable access door 204 open, while other storage receptacles 104 are depicted with their lockable access doors 204 closed.

The storage receptacle 104 includes a fire suppression device 114. The fire suppression device 114 may include a sensor 208 and a container 210 to store a charge of fire suppression/extinguishing material. The sensor 208 may include a heat sensor, a fire sensor, a smoke sensor, or similar sensor to detect a sign of fire. The sensor 208 may trigger the container 210 to release fire suppression/extinguishing material into the storage receptacle 104, so as to suppress or extinguish a fire therein.

The locking mechanism 206 of the storage receptacle 104 may include an electromagnetic mechanism that may be controlled based on a signal from the sensor 208. The storage receptacle 104 may be automatically locked closed when the sensor 208 detects a sign of fire within the storage receptacle 104. As such, a storage receptacle 104 that may contain a fire or harmful products of combustion may be locked closed until human intervention is possible. In other examples, as an added precaution, a group of storage receptacles 104 may be automatically locked closed when a sign of fire is detected in a particular storage receptacle 104. In still other examples, the entire array of storage receptacles 104 may be automatically locked closed when a sign of fire is detected.

FIG. 2 also shows an example electronic device 214 positioned within a storage receptacle 104 and connected to a power port 216 and network communications port 218 (e.g., an Ethernet port) provided to inside the storage receptacle 104. The power port 216 may be used to charge a battery of the electronic device 214 and the network communications port 218 may be used as a pathway to maintain software at the electronic device 214. As noted above, the power port 216, the network communications port 218, or the battery of the electronic device 214 may be a cause of a fire within the storage receptacle 104.

Figure 3:
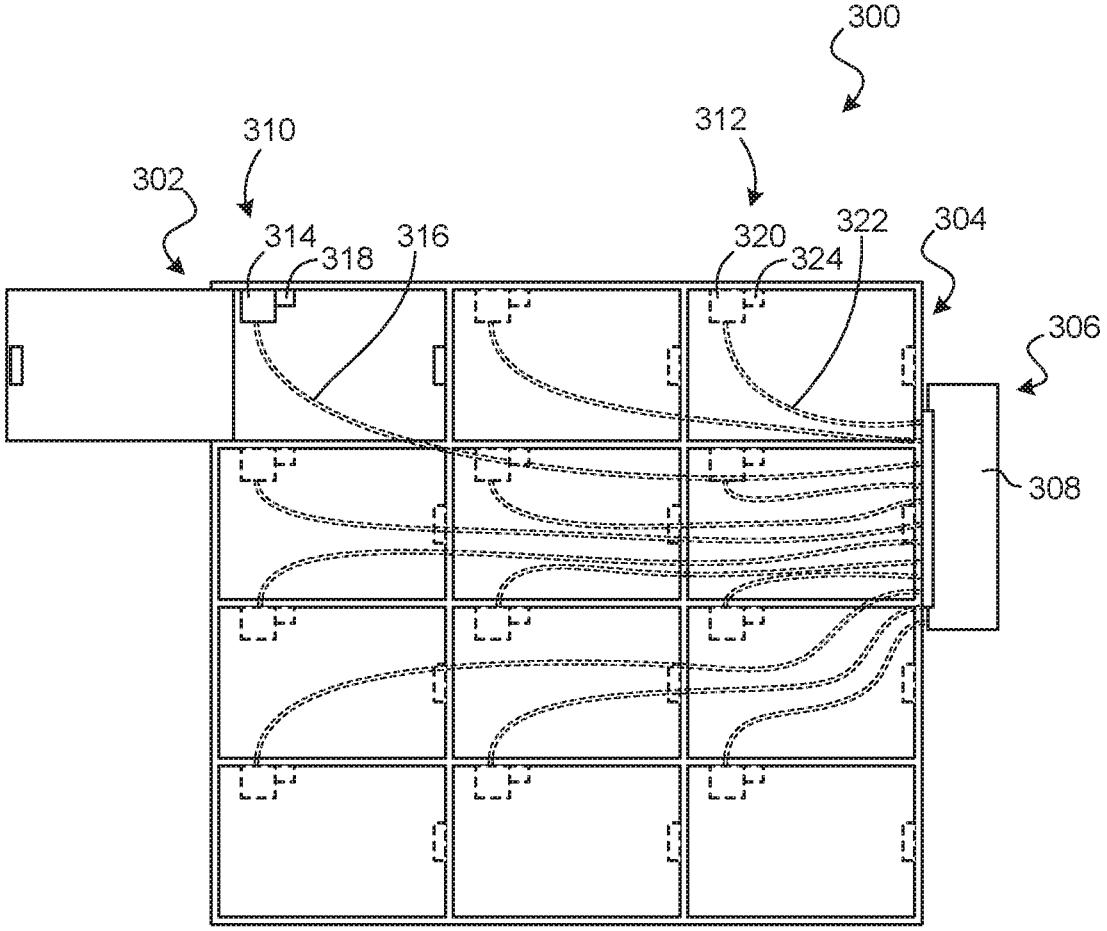
FIG. 3 is a front view of an example apparatus to provide fire suppression to device storage receptacles with a common source of fire suppression/extinguishing material.

FIG. 3 shows another example apparatus 300 to provide fire suppression to device storage receptacles. Features and aspects of other apparatuses disclosed herein may be used with the apparatus 300. Like reference numerals denote like components and redundant description is omitted for clarity.

The apparatus 300 includes an array of storage receptacles, including a first storage receptacle 302 and a second storage receptacle 304. The storage receptacles 302, 304 may be similar or identical to the other storage receptacles described herein.

The apparatus 300 further includes a fire suppression mechanism 306 that may include a container 308 to store a charge of fire suppression/extinguishing material, a first fire suppression device 310 at the first storage receptacle 302, and a second fire suppression device 312 at the second storage receptacle 304. The container 308 may provide a common source of fire suppression/extinguishing material to a plurality of storage receptacles 302, 304.

The first fire suppression device 310 may include a first nozzle 314 to expel fire suppression/extinguishing material into the first storage receptacle 302 and a first conduit 316 that communicates fire suppression/extinguishing material from the container 308 to the first nozzle 314. The first fire suppression device 310 may further include a first sensor 318 connected to the first nozzle 314. The first sensor 318 may trigger a valve or similar mechanism of the first nozzle 314 to expel fire suppression/extinguishing material in response to detection of fire, heat, smoke, or other sign of fire within the first storage receptacle 302.

Similarly, the second fire suppression device 312 may include a second nozzle 320 to expel fire suppression/extinguishing material into the second storage receptacle 304 and a second conduit 322 that communicates fire suppression/extinguishing material from the container 308 to the second nozzle 320. The second fire suppression device 312 may further include a second sensor 324 connected to the second nozzle 320 to trigger a valve or similar mechanism of the second nozzle 320 to expel fire suppression/extinguishing material in response to detection of fire, heat, smoke, or other sign of fire within the second storage receptacle 304.

The container 308 that stores a charge of fire suppression/extinguishing material may be common to the first and second fire suppression devices 310, 312, while allowing for independent triggering and operation of the first and second fire suppression devices 310, 312.

Figure 4:
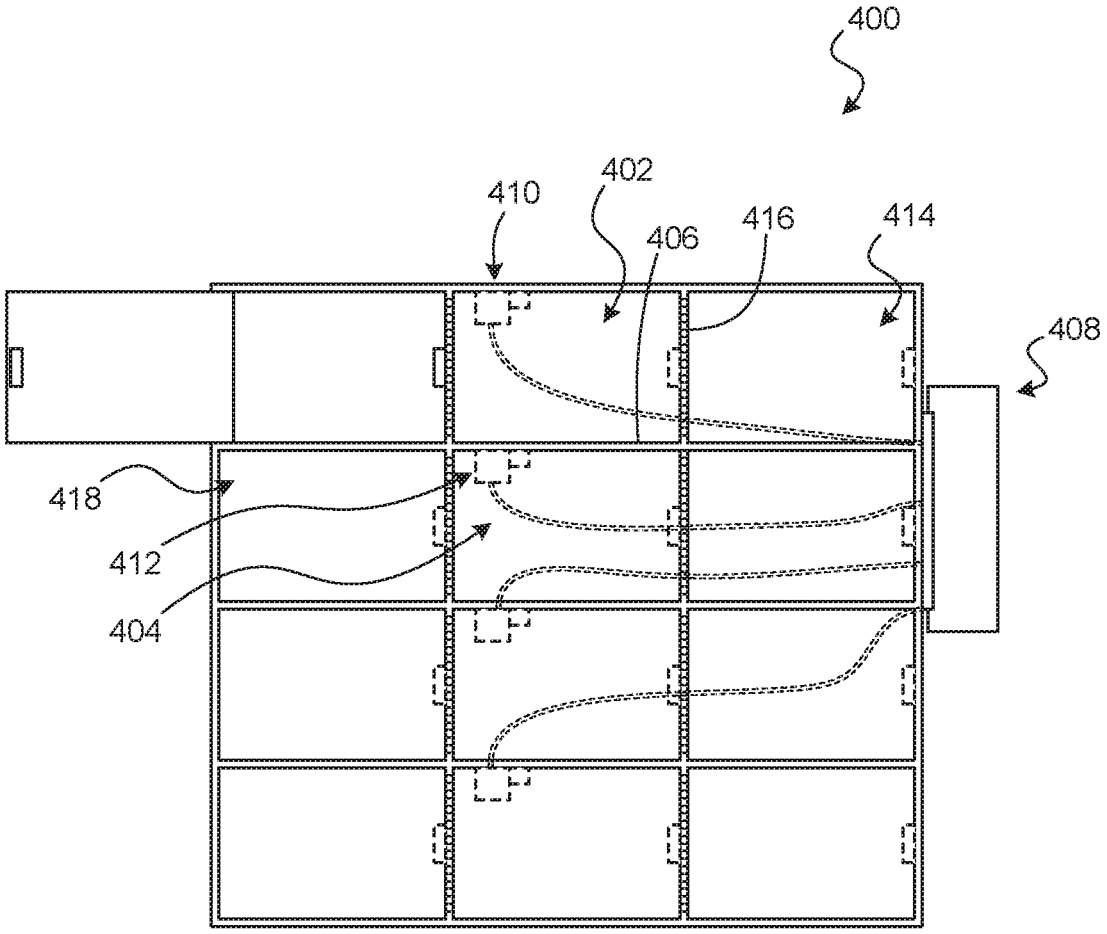
FIG. 4 is a front view of an example apparatus to provide fire suppression to device storage receptacles with communication between a group of device storage receptacles.

FIG. 4 shows another example apparatus 400 to provide fire suppression to device storage receptacles. Features and aspects of other apparatuses disclosed herein may be used with the apparatus 400. Like reference numerals denote like components and redundant description is omitted for clarity.

The apparatus 400 includes an array of storage receptacles including a first storage receptacle 402 and a second storage receptacle 404. The storage receptacles 402, 404 may be similar or identical to the other storage receptacles described herein. The storage receptacles 402, 404 may be separated by a barrier 406, such as a solid wall, that may include fire-resistant material. The barrier 406 may prevent physical access between the storage receptacles 402, 404 and may further prevent the spread of fire, heat, or smoke. The barrier 406 may block the communication of fire suppression/extinguishing material between storage receptacles 402, 404. The barrier 406 may be similar or identical to the other barriers described herein.

The apparatus 400 further includes a fire suppression mechanism 408 that may be similar or identical to the other fire suppression mechanisms described herein. The fire suppression mechanism 408 may include a first fire suppression device 410 at the first storage receptacle 402 and a second fire suppression device 412 at the second storage receptacle 404. The fire suppression devices 410, 412 may be similar or identical to the other fire suppression devices described herein.

The apparatus 400 further includes an additional storage receptacle 414 in physical communication with the first storage receptacle 402. Such physical communication may prevent physical access to an electronic device stored in the first storage receptacle 402 through the additional storage receptacle 414, and vice versa. For example, a divider 416 may physically separate the storage receptacles 402, 414, while allowing air communication therebetween. The divider 416 may include mesh, expanded metal, cage, or similar structure having openings that prevent the passage of an electronic device but allow the communication of fire suppression/extinguishing material. Due to such communication, the additional storage receptacle 414 may receive fire suppression from the fire suppression mechanism 408 simultaneously with the first storage receptacle 402 via the same first fire suppression device 410.

The above may also apply to another group of storage receptacles including the second storage receptacle 404 and a communicating storage receptacle 418.

A group of access-separated storage receptacles 402, 414 may be in communication for fire suppression purposes, so as to reduce a number of fire suppression devices provided. For example, the fire suppression device 410 may detect and suppress a fire, irrespective of whether such fire originated in the first storage receptacle 402 or a communicating storage receptacle 414.

The array of storage receptacles may be grouped for fire suppression in rows (as depicted), columns, pairs, triplets, or similar grouping. Fire suppression may be provided independently to different groups. In another example, all storage receptacles of an apparatus are grouped, such that fire suppression is performed collectively while physical access is provided independently. Grouping storage receptacles for fire suppression may allow for optimization of implementation complexity with respect to risk and potential damage due to fire. That is, several electronic devices may be exposed to risk together to reduce complexity that would otherwise be implemented by isolating such risk.

Grouping may be made based on an available amount of fire suppression/extinguishing material at the apparatus 400. For example, a total volume of a group of storage receptacles may be selected to match a particular quantity of fire suppression/extinguishing material, such as a total volume of fire suppression/extinguishing material provided to the apparatus 400. This may allow for efficient provision of fire suppression/extinguishing material.

Grouping may be made based on expected movement of fire suppression/extinguishing material within the apparatus 400. For example, if the fire suppression/extinguishing material is heavier than air, then a group of storage receptacles may be vertically arranged with a fire suppression device being located at an upper storage receptacle, so that fire suppression/extinguishing material flows downwards into a communicating storage receptacle.

Figure 5:
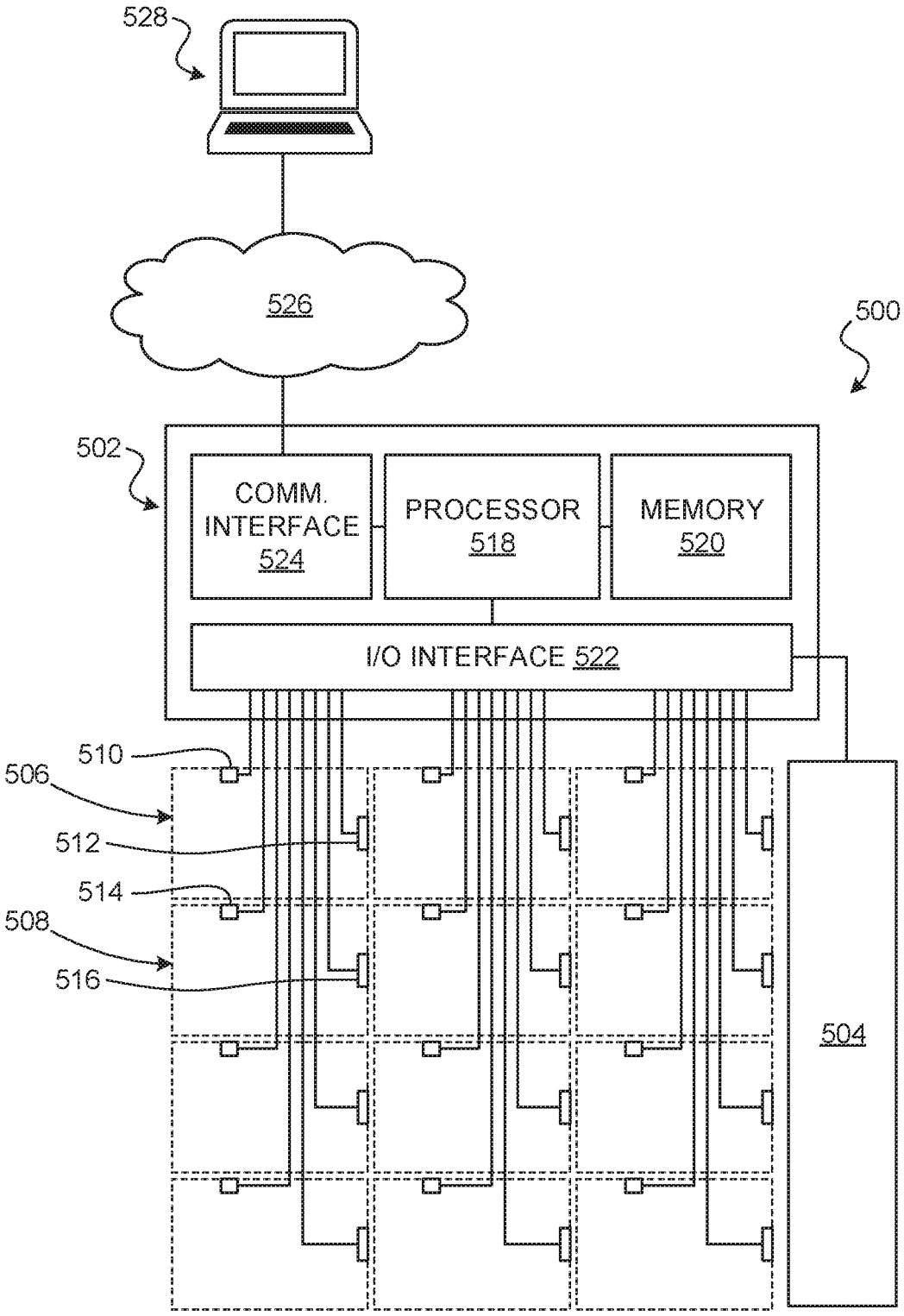
FIG. 5 is a schematic view of an example apparatus to provide fire suppression to device storage receptacles with automatic locking of a receptacle door.

FIG. 5 shows another example apparatus 500 to provide fire suppression to device storage receptacles. Features and aspects of other apparatuses disclosed herein may be used with the apparatus 500. Like reference numerals denote like components and redundant description is omitted for clarity.

The apparatus includes a circuit 502, a fire suppression mechanism 504, and an array of storage receptacles including a first storage receptacle 506 and a second storage receptacle 508. The storage receptacles 506, 508 may be similar or identical to the other storage receptacles described herein.

The fire suppression mechanism 504 may be similar or identical to the other fire suppression mechanisms described herein.

The first storage receptacle 506 includes a first sensor 510 and a first locking mechanism 512. The first storage receptacle 506 further includes a first lockable access door (not shown) that is lockable by the first locking mechanism 512. The first locking mechanism 512 may include an electromechanical lock (e.g., a solenoid lock) that is controllable by a signal from the circuit 502. The first sensor 510 may be connected to the fire suppression mechanism 504 to detect a sign of fire within the first storage receptacle 506 and, in response, trigger the ejection of fire suppression/extinguishing material into the first storage receptacle 506.

Similarly, the second storage receptacle 508 includes a second sensor 514 and a second locking mechanism 516. The second storage receptacle 508 further includes a second lockable access door (not shown) that is lockable by the second locking mechanism 516. The second locking mechanism 516 may include an electromechanical lock (e.g., a solenoid lock) that is controllable by a signal from the circuit 502. The second sensor 514 may be connected to the fire suppression mechanism 504 to detect a sign of fire within the second storage receptacle 508 and, in response, trigger the ejection of fire suppression/extinguishing material into the second storage receptacle 508.

The circuit 502 may include a processor 518, memory 520, an input/output interface 522, and a communications interface 524.

The processor 518 may include a central processing unit (CPU), a microcontroller, a microprocessor, a processing core, a field-programmable gate array (FPGA), and/or similar device capable of executing instructions. The processor 518 may cooperate with a non-transitory machine-readable medium, such as the memory 520, that may be an electronic, magnetic, optical, and/or other physical storage device that encodes processor-executable instructions. The machine-readable medium may include, for example, random access memory (RAM), read-only memory (ROM), electrically-erasable programmable read-only memory (EEPROM), flash memory, a storage drive, an optical disc, and/or similar.

The input/output interface 522 may connect the processor 518 to the sensors 510, 514 and to the locking mechanisms 512, 516. The input/output interface 522 may communicate data and control signals between the processor 518 and the sensors 510, 514 and locking mechanisms 512, 516. The input/output interface 522 may further connect the fire suppression mechanism 504 to the processor 518.

The processor 518 may control the fire suppression mechanism 504 based on signals received from the sensors 510, 514. In other examples, the fire suppression mechanism 504 is independently controlled based on signals received from the sensors 510, 514, with such signals also being provided to the processor 518 to control the locking mechanisms 512, 516.

The communications interface 524 is connected to the processor 518 and provides data communications between the processor 518 and a computer network 526, such as a local-area network (LAN), wireless LAN, wide-area network (WAN), wireless WWAN, the internet, or similar.

The processor 518 may automatically lock closed the first lockable access door of the first storage receptacle 506 when the fire suppression mechanism 504 activates to suppress a fire in the first storage receptacle 506. The processor 518 may reference a signal received from the first sensor 510 to determine whether to lock the first storage receptacle 506 closed. As such, access to the first storage receptacle 506 may be denied during and after a fire, so as to reduce the risk of harm to users and of damage to the surroundings. The same applies to the second storage receptacle 508 with its sensor 514 and locking mechanism 516. The second storage receptacle 508 may be independently locked closed in response to detection of a sign of fire therein.

The processor 518 may further automatically lock closed the second lockable access door of the second storage receptacle 508 when the fire suppression mechanism 504 activates to suppress a fire in the first storage receptacle 506. That is, multiple different storage receptacles 506, 508 may be locked closed in response to detection of a sign of fire within a particular storage receptacle 506, 508. In some examples, storage receptacles adjacent to a storage receptacle containing a fire may be locked closed to reduce risk posed to a user due to the spread of heat or smoke. When storage receptacles are grouped, all storage receptacles within the group that contains the fire may be locked closed in response to detection of a sign of fire within a member of the group.

A signal outputted by the first sensor 510 or the second sensor 514 may be provided to the processor 518 via the input/output interface 522. The processor 518 may generate a fire notification based on such signal and cause the fire notification to be transmitted by the communications interface 524 to a remote electronic device 528, such as an administrator's computer. This way, a remote administrator may be notified of the fire and may undertake an intervention or schedule maintenance to the apparatus 500. In other examples, the processor 518 may initiate a call to emergency services.

The processor 518 may additionally provide user access to the storage receptacles 506, 508 via the locking mechanisms 512, 516. A user interface, such as a touchscreen, security badge scanner, keypad, or similar may be provided to facilitate user access to devices stored within the apparatus 500. User access may be authorized or controlled by a remote server that may be queried via the communications interface 524. The cause of a fire may be traced back to a particular device and a particular user who deposited that device into the apparatus 500.

Figure 6:
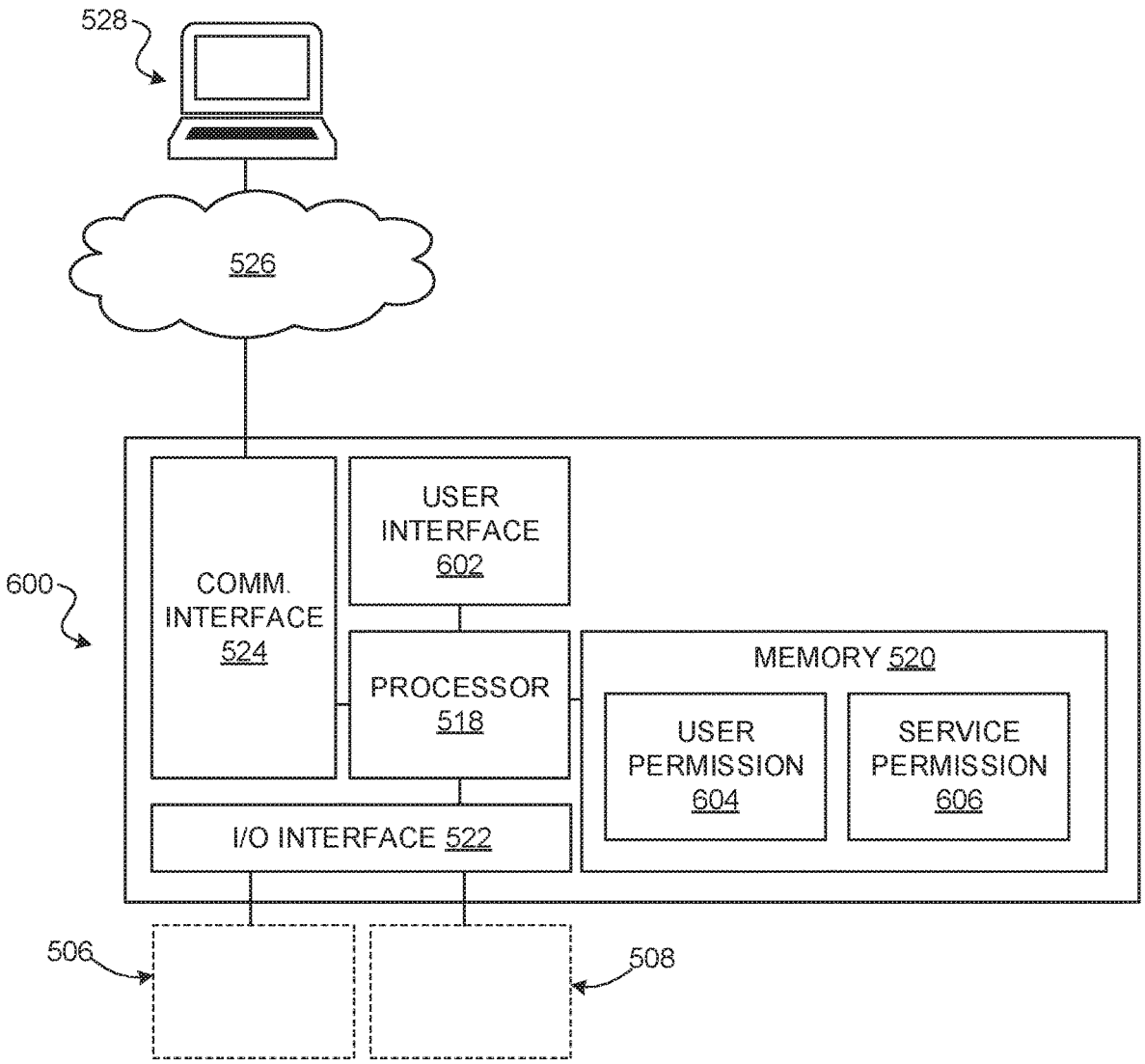
FIG. 6 is a schematic view of an example apparatus to provide fire suppression to device storage receptacles with service access.

FIG. 6 shows another example circuit 600 to provide fire suppression to device storage receptacles. Features and aspects of other circuits and apparatuses disclosed herein may be used with the circuit 600. Like reference numerals denote like components and redundant description is omitted for clarity.

The circuit 600 may include a processor 518, memory 520, input/output interface 522, and communications interface 524, as discussed elsewhere herein. The circuit 600 may further include a user interface 602, such as a touchscreen, security badge scanner, keypad, or similar.

The processor 518 may provide user access, via the input/output interface 522, to storage receptacles 506, 508 with different permission levels 604, 606. A user permission level 604 may be assigned to a user who is to access a particular storage receptacle 506, 508 to obtain or return an electronic device. A service permission level 606 may be assigned to a person who is to manually intervene or provide maintenance in case of a fire.

A service permission level 606 may be granted in response to detection of a fire, such as in response to a signal from a sensor at a storage receptacle 506, 508. A service permission level 606 may be time-limited and automatically expire after a time allowed for intervention or service after a fire. In some examples, a service permission level 606 is specific to detected fire events and is different from a maintenance permission level associated with normal maintenance, as the individuals responsible for service after a fire and normal maintenance, and the tasks they are to perform, may be different.

A service permission level 606 may grant access to a storage receptacle 506, 508 that has experienced a fire, as determined by its sensor. For example, a particular code provided to the processor 518 via the communications interface 524 or user interface 602 may trigger the processor 518 to open the affected storage receptacle 506, 508, while keeping other storage receptacles 506, 508 in their present state (e.g., locked). In other examples, a service permission level 606 may grant physical access to a group of storage receptacles 506, 508. For example, a particular code provided to the processor 518 via the communications interface 524 or user interface 602 may trigger the processor 518 to open a group of storage receptacles 506, 508 that share a fire suppression device.

As should be apparent from the above description, a storage apparatus may store a plurality of electronic devices and may provide fire suppression to receptacles that contain the electronic devices. Fire suppression may be provided independently to different storage receptacles. Fire suppression may be provided to a group of storage receptacles or independently to different groups of storage receptacles. Danger posed by fire, such as may be caused by damaged or defective batteries, may be reduced. The availability of electronic devices, even after a fire occurs, may be increased.

The word "or" as used herein is not limited to exclusive alternatives and may denote elements that may be used in combination. The word "or" may be read as "and/or".

It should be recognized that features and aspects of the various examples provided above may be combined into further examples that also fall within the scope of the present disclosure.

The invention claimed is:

1. An apparatus comprising:

a cabinet body;

a first storage receptacle within the cabinet body, the first storage receptacle to temporarily store a first electronic device;

a second storage receptacle within the cabinet body, the second storage receptacle to temporarily store a second electronic device;

a divider wall shared by the first storage receptacle and the second storage receptacle, the divider wall configured to physically separate the second storage receptacle from the first storage receptacle to prevent physical access to the first storage receptacle through the second storage receptacle;

a container to store fire suppression material;

a conduit fluidically connected to the container; and a valve in the first storage receptacle and fluidically connected to the conduit, the valve to release the fire suppression material within the first storage receptacle;

wherein the divider wall defines a surface including a plurality of uniformly spaced openings sized to prevent passage of the first or second electronic devices and to allow flow of the fire suppression material from the first storage receptacle to the second storage receptacle;

wherein the valve is configured to deliver fire suppression material simultaneously to both the first storage receptacle and the second storage receptacle;

wherein the divider wall is the only obstacle between the first storage receptacle and the second storage receptacle;

wherein the first storage receptacle comprises a first lockable access door; and wherein the second storage receptacle comprises a second lockable access door, the second lockable access door to automatically lock closed in response to the valve activating to release the fire suppression material to suppress the fire in the first storage receptacle.

2. The apparatus of claim 1, wherein the first lockable access door is configured to automatically lock closed when the valve activates to release the fire suppression material to suppress the fire in the first storage receptacle.

3. The apparatus of claim 2, further comprising a circuit to control the first lockable access door to provide user access to the first storage receptacle, the circuit further to control the first lockable access door to provide service access to open the first lockable access door after the fire.

4. The apparatus of claim 1, further comprising a first sensor to detect a sign of fire in the first storage receptacle and a second sensor to detect a sign of fire in the second storage receptacle, the first sensor connected to the valve to trigger the valve to release the fire suppression material in the first storage receptacle to suppress the fire in the first storage receptacle, the second sensor connected to the valve to trigger the valve to release the fire suppression material in the first storage receptacle to suppress the fire in the second storage receptacle.

5. The apparatus of claim 1, further comprising a communications interface and a first sensor connected to the communications interface, the first sensor to trigger the valve to release the fire suppression material to suppress the fire in the first storage receptacle and to generate a fire notification to be transmitted by the communications interface to a remote electronic device.

6. The apparatus of claim 1, further comprising a barrier positioned between the first storage receptacle and an additional storage receptacle to separate the first storage receptacle and the additional storage receptacle, the barrier including fire-resistant material.

7. The apparatus of claim 1, wherein the divider wall includes mesh, expanded metal, or a cage structure that includes the plurality of openings.

8. An apparatus, comprising:

a cabinet body;

a first storage receptacle within the cabinet body, the first storage receptacle to temporarily store a first electronic device;

a second storage receptacle within the cabinet body, the second storage receptacle to temporarily store a second electronic device;

a divider wall shared by the first storage receptacle and the second storage receptacle, the divider wall configured to physically separate the second storage receptacle from the first storage receptacle to prevent physical access to the first storage receptacle through the second storage receptacle; and a first fire suppression system in fluidic communication with the first storage receptacle;

wherein the divider wall defines a surface including a plurality of uniformly spaced openings sized to prevent passage of the first or second electronic devices between the first and second storage receptacles and to allow flow of fire suppression material released by the first fire suppression system between the first storage receptacle to the second storage receptacle;

wherein the first fire suppression system is configured to deliver fire suppression material simultaneously to both the first storage receptacle and the second storage receptacle;

wherein the divider wall is the only obstacle between the first storage receptacle and the second storage receptacle;

wherein the first storage receptacle includes a power port configured to charge the first electronic device;

wherein the first storage receptacle comprises a first lockable access door; and wherein the second storage receptacle includes a second lockable access door.

9. The apparatus of claim 8, wherein the second lockable access door is configured to automatically lock closed in response to activation of the first fire suppression system.

10. The apparatus of claim 9, wherein the first lockable access door is configured to automatically lock closed in response to activation of the first fire suppression system.

11. The apparatus of claim 8, further comprising:

a first sensor to detect a sign of fire in the first storage receptacle; and a second sensor to detect a sign of fire in the second storage receptacle.

12. The apparatus of claim 11, wherein the first sensor is in electrical communication with the first fire suppression system to trigger a release of fire suppression material in the first storage receptacle to suppress the fire in the first storage receptacle.

13. The apparatus of claim 12, wherein the second sensor is in electrical communication with the first fire suppression system to trigger a release of fire suppression material in the first storage receptacle to suppress the fire in the second storage receptacle.

14. The apparatus of claim 8, wherein the first storage receptacle includes a network communications port configured to enable communications between the first electronic device and a remote device.

15. The apparatus of claim 10, wherein the first lockable access door includes an electromagnetic lock, and wherein the electromagnetic lock is in electrical communication with a first sensor to lock and unlock the first access door based on one or more signals from the sensor.

16. An apparatus, comprising:

a cabinet body;

a fire suppression system within the cabinet body, including:

a container configured to store fire suppression material;

one or more fire suppression valves in fluidic communication with the container, the one or more fire suppression valves configured to expel fire suppression material; two or more storage receptacles within the cabinet body, each including:

a network communications port configured to enable communication between an electronic device stored within the storage receptacle and a remote device;

a power port configured to charge the electronic device within the storage receptacle; and an access door configured to automatically lock in response to a signal from a sensor within the two or more storage receptacles;

wherein the signal indicates that a fire is detected within the two or more storage receptacles;

wherein the fire suppression system is configured to deliver fire suppression material simultaneously to the two or more storage receptacles;

wherein the two or more storage receptacles are only separated by a common divider wall defining a surface including a plurality of uniformly spaced openings configured to allow movement of fire suppression material between the two or more storage receptacles; and wherein the two or more storage receptacles each include a lockable access door.

17. The apparatus of claim 16, wherein the two or more storage receptacles includes a first storage receptacle and a second storage receptacle, and wherein the first storage receptacle and the second storage receptacle share a common fire suppression valve.

18. The apparatus of claim 17, wherein the plurality of openings are sized to enable flow of fire suppression material between the first storage receptacle and the second storage receptacle such that fire suppression material released into the first storage receptacle extinguishes a fire within the second storage receptacle.

19. The apparatus of claim 17, wherein the first storage receptacle includes a first access door and the second storage receptacle includes a second access door, and wherein both the first and second access door each automatically lock in response to a signal from a sensor within the first storage receptacle.

* * * * *